US006296460B1

(12) United States Patent
Smith

(10) Patent No.: US 6,296,460 B1
(45) Date of Patent: Oct. 2, 2001

(54) ROTARY CAVITY PUMP

(76) Inventor: Steve C. Smith, 14011 Woodlawn Ave., Tustin, CA (US) 92780

( * ) Notice: Subject to any disclaimer, the term of this patent is extended or adjusted under 35 U.S.C. 154(b) by 0 days.

(21) Appl. No.: 09/516,906

(22) Filed: Mar. 1, 2000

(51) Int. Cl.[7] ..... F04B 43/08
(52) U.S. Cl. ..... 417/475; 477/477.5; 92/71
(58) Field of Search ..... 417/474, 475, 417/477.1, 477.3, 477.5, 476; 92/71

(56) References Cited

U.S. PATENT DOCUMENTS 612,834 * 10/1898 Dieckmann ..... 417/477.1
2,841,091 * 7/1958 Schaurte ..... 417/477.1
3,922,119 * 11/1975 Rosenquist ..... 417/474
5,676,035 * 10/1997 Chrestoff et al. ..... 92/71

* cited by examiner

*Primary Examiner*—Charles G Freay
(74) *Attorney, Agent, or Firm*—Roy A. Ekstrand

(57) ABSTRACT

A pump housing supports a plurality of pump segments each having a raised pump cavity enclosed by a resilient diaphragm sealed to the pump cavity. A compression plate supports a plurality of rollers against the pump segments. The compression plate is rotatable with respect to the pump housing to move the rollers across the pump segments deforming the diaphragms and expelling fluid from the pump segments. Fluid passages couple each pump cavity to a source of fluid and a fluid output. As each roller rolls across each diaphragm to expel fluid from the pump segment, the resilience of the diaphragm draws fluid into the pump segment behind the roller to refill the pump segment.

19 Claims, 8 Drawing Sheets

ROTARY CAVITY PUMP

FIELD OF THE INVENTION

This invention relates generally to fluid pumps and particularly to those capable of precision small volume fluid metering delivery.

BACKGROUND OF THE INVENTION

Pumps comprise one of the most common and well developed as well as well known types of basic machines. The essential function of a pump is the displacement and movement or pressurization of a fluid. The majority of pumps may be divided into a basic classification as either reciprocating or rotary action pumps. Reciprocating pumps typically utilize one or more cylinders together with appropriate valves for controlling fluid flow to and from the cylinders. Each cylinder is fitted with a moving piston which in turn is usually coupled to crank mechanism for imparting piston movement within the cylinder in response to rotation of an input power or drive shaft.

In contrast, rotary pumps may be generally characterized as apparatus having a shaft coupled to a source of rotary power which is supported within a pump body. The latter, defines a chamber or cavity within which a fluid movement or displacement device is rotated by the input power shaft. Perhaps the most pervasive type of rotary pump may be generally described as an impeller type pump. In such pumps, a rotor is positioned within the pump chamber and rotated by the input power shaft. The rotor in turn supports a plurality of blades which are sized and configured in general correspondence with the interior chamber of the pump housing. An input port and an output port are formed in the pump housing in communication with the chamber. As the input drive shaft rotates the rotor and its plurality of impeller blades within the pump chamber, the fluid is drawn into the chamber through the input port and forced outwardly through the output port.

Another type of rotary pump is typically referred to as a turban or vane type pump. The turban or vane pump utilizes a housing defining a chamber which is usually cylindrical in shape which supports a plurality of static vanes radially disposed within the chamber interior. An armature is rotatably supported within the pump chamber and further supports a plurality of rotating vanes which are moveable with respect to the static vanes. A drive shaft is coupled to a source of operative rotary power and is further coupled to the armature. As rotary power is applied to the armature, the interaction of the rotating vanes and static vanes produces a turban-like displacement of the fluid within the chamber. Typically an input port is coupled to one end of the chamber while an output port is coupled to the downstream end of the pump chamber.

Still another type of rotary action pump is referred to generally as a "peristaltic" which is often referred to as a "hose pump". Peristaltic pumps utilize a housing within which a generally cylindrical chamber is formed. A flexible tubing or hose is positioned against the outer surface of the housing chamber. One end of the tubing or hose is coupled to an input fluid supply while the remaining end forms an output port for the pump. A rotor is rotatably supported within the chamber and further supports one or more rollers about its periphery. The rollers are positioned against the flexible tubing or hose and are of sufficient size to deform the hose to provide pinching or closure at the point of roller pressure. A drive shaft is coupled to the rotor and to a source of rotational power. As the rotor rotates, the rollers displace quantities of fluid in the direction of rotor rotation to transfer the fluid from the input source to the output port.

While most pumps are used in applications which require the pumps to simply run for relatively long periods at a so-called steady state, in certain environments pumps must also be capable of providing short term small volume runs to transfer fluid in more precise quantities. Such pumps are often referred to as "fluid metering" pumps and are characterized by precise volume delivery of fluid. In many instances, such fluid metering pumps are used in an operative environment in which the rotating member is moved through small angular displacements substantially less than a full rotation.

While the above described prior art pumps have been the subject of substantial refinement and development, they have yet to provide pumps which are capable of both steady state operation and fluid metering operation. Many of the above described prior art pumps have been subject to an undesirable tendency to impart a pulsating characteristic to the fluid flow. There remains therefore a continuing need in the art for an improved rotary drive pump which is capable of providing smooth pulse free fluid flow as well as accurate fluid metering operation.

SUMMARY OF THE INVENTION

Accordingly, it is a general object of the present invention to provide an improved rotary cavity pump. It is a more particular object of the present invention to provide an improved rotary cavity pump which is capable of providing extremely precise fluid metering operation through partial pump revolution as well as relatively pulse-free fluid flow during more conventional pump action.

In accordance with the present invention there is provided a rotary cavity pump for pumping a fluid, the pump comprising: a pump housing having a plurality of pump cavities each defining a pump recess and first and second apertures in the recess; a plurality of diaphragms sealingly supported upon the plurality of pump cavities each of the diaphragms being formed of a flexible resilient material having a relaxed shape which together with the pump recesses forms a sealed fluid cavity having the first and second apertures therein; a first fluid coupling and means for coupling the first fluid coupling to the first apertures; a second fluid coupling and means for coupling the second fluid coupling to the second apertures; a plurality of diaphragm compression members; and means for moving the plurality of diaphragm compression members upon and across the diaphragms, the diaphragms being compressed into the recesses to block the first apertures and captivate a quantity of fluid and to expel the quantity outwardly through the second apertures.

In one anticipated embodiment of the present invention, a rotary cavity pump for pumping a fluid comprises, a transfer plate having a plurality of arcuate pump cavities each defining an arcuate recess, a first aperture and first passage at one end of the recess and a second aperture and second passage at the remaining end of the recess; a manifold coupled to the transfer plate having a first fluid port coupled to each of the first passages and a second fluid port coupled to each of the second passages; a plurality of resilient diaphragms each sealingly supported upon one of the pump cavities; and a compression plate rotatably supported with respect to the diaphragms and having a plurality of compression members, the compression members compressing the diaphragms as the compression plate rotates to isolate fluid within the recesses and expel it through the second apertures and the second passages.

In still another respect, the present invention provides a rotary cavity pump for use with a fluid, said pump comprising: a pump housing; a compression plate rotatably supported on the pump housing and having a plurality of compression members; a plurality of deformable pump segments supported by the pump housing against the compression members, each of the deformable pump segments including, an elongated pump cavity having an elongated recess having apertures at each end thereof, and a resilient diaphragm covering the pump cavity, the resilient diaphragm deforming and reforming as a compression member is moved upon it to draw fluid into the recess through one of the apertures and expel fluid out from the recess through the remaining one of the apertures.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
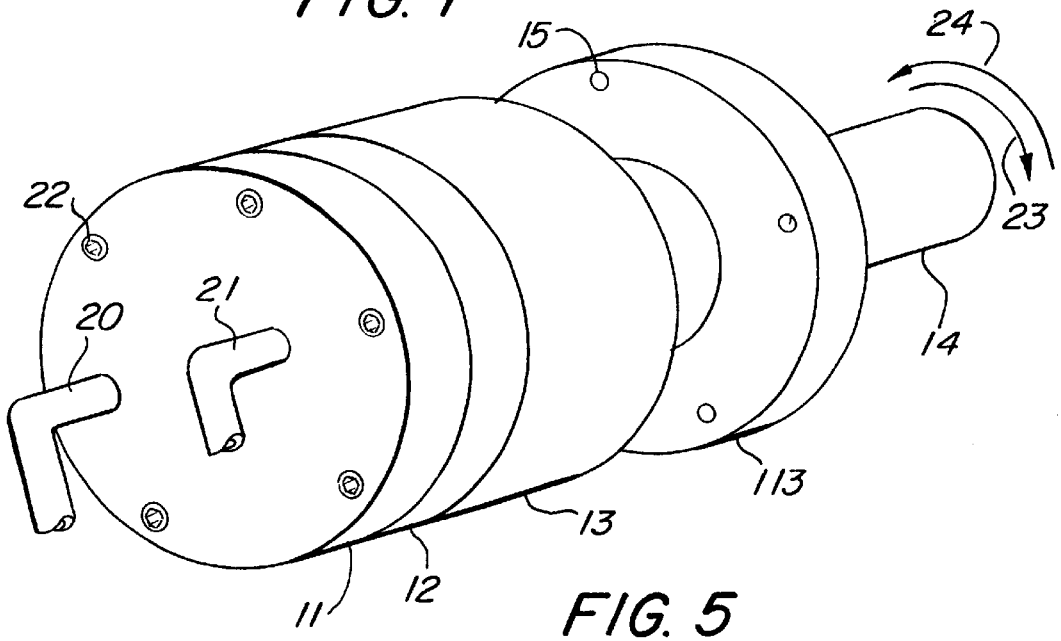
FIG. 1 sets forth a perspective view of a rotary cavity pump constructed in accordance with the present invention.

FIG. 1 sets forth a perspective view of a rotary drive cavity pump constructed in accordance with the present invention and generally referenced by numeral 10. Pump 10 includes a pump body 13 having a transfer plate 12 and a manifold 11 secured thereto by a plurality of conventional fasteners 22. Manifold 11 is set forth below in FIGS. 3 and 4 in greater detail. However, suffice it to note here that manifold 11 supports a pair of fluid couplers 20 and 21 which in accordance with conventional fabrication techniques are operatively coupled to fluid processing means (not shown).

Pump body 13 further includes an outwardly extending flange 113 which may be utilized in securing pump 10 within a host fluid processing system. Toward this end, flange 113 defines a plurality of apertures 15 which may receive conventional fasteners for securing pump 10 as desired. Pump 10 further includes a compression plate shaft 14 which as is set forth below in FIG. 2 in greater detail is the input rotary power apparatus for pump 10. Accordingly, in the anticipated use of pump 10, compression plate shaft 14 is coupled to a source of rotary power for operating pump 10. In accordance with an important advantage of the present invention pump, compression plate shaft 14 may be rotated in either of the rotational directions indicated by arrows 23 and 24. Correspondingly, by means set forth below in greater detail, rotation of compression plate shaft 14 in one direction causes fluid to be drawn into one of couplers 20 and 21 and expelled under pressure through the remaining one of the couplers. Conversely, the rotation of compression plate shaft 14 in the opposite direction produces an opposite input verses output relationship between fluid couplers 20 and 21. Accordingly, pump 10 is "bi-directional" meaning that the pump may be operated in either direction of rotation. In further accordance with the present invention and as is set forth below in greater detail, pump 10 may operate in either a steady state conventional pumping mode in which fluid is drawn into one of the fluid couplers and expelled from the other under pressure or alternatively compression plate shaft 14 may be incrementally rotated through precise angles to provide a metered flowed operation for pump 10.

Figure 2:
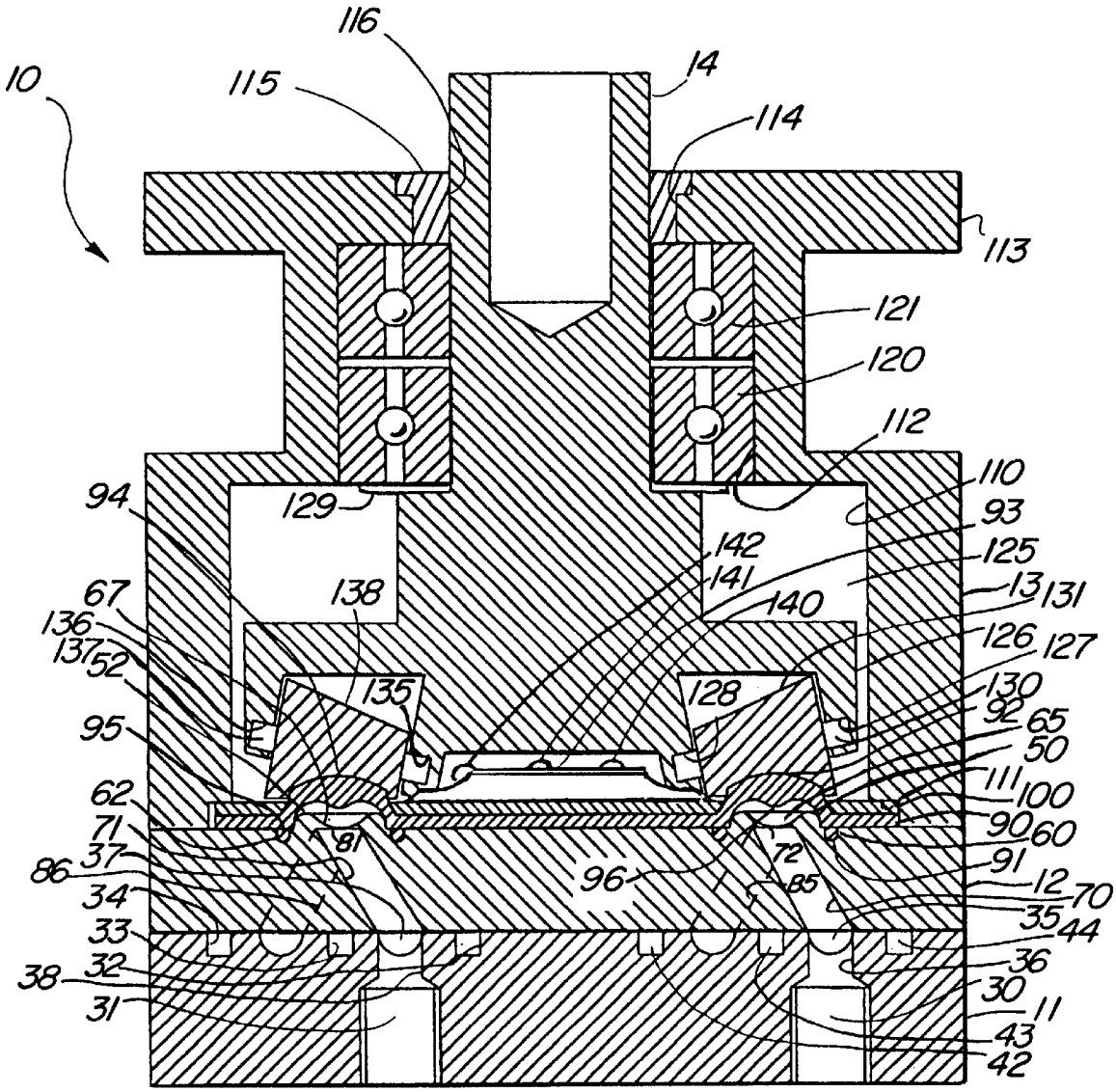
FIG. 2 sets forth a section view of the rotary cavity pump of FIG. 1.

FIG. 2 sets forth a section view of pump 10. Pump 10 includes a manifold 11 defining a generally cylindrical shape and having a pair of concentric fluid grooves 35 and 37 formed therein. Fluid groove 35 is substantially larger in diameter than fluid groove 37 and is coupled to a passage 36. Passage 36 in turn is coupled to a fluid port 30. In the preferred fabrication of the present invention, fluid port 30 defines a plurality of internal threads for receiving a conventional coupler such as fluid coupler 20 (seen in FIG. 1). Fluid groove 37 is similarly coupled to a passage 38 which in turn communicates with a fluid port 31. Fluid port 31 preferably defines a plurality of internal threads for receiving a fluid coupler such as fluid courler 21 (seen in FIG. 1). Manifold 11 further defines a plurality of generally concentric seal grooves 32, 33 and 34. A corresponding plurality of resilient seals 42, 43 and 44 are received within grooves 32, 33 and 34 respectively. The function of grooves 32 through 34 and resilient seals 42 through 44 is to provide isolation between fluid grooves 35 and 37.

Figure 5:
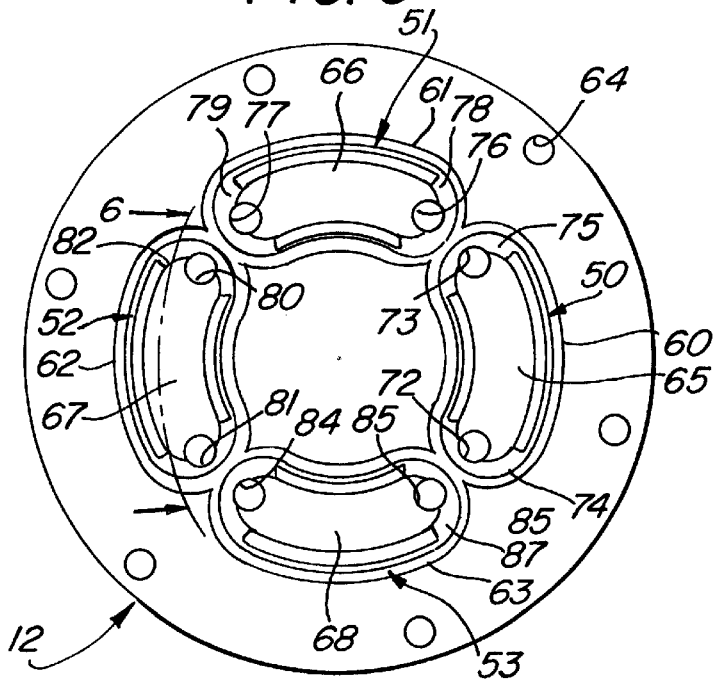
FIG. 5 sets forth a top plan view of the transfer plate component of the present invention rotary cavity pump.

Pump 10 further includes a generally cylindrical transfer plate 12 which is secured against the upper surface of manifold 11 such that seals 42, 43 and 44 are compressed by the under surface of transfer plate 12 to provide a sealing attachment. As is better seen in FIG. 5, transfer plate 12 defines a plurality of pump cavities 50, 51, 52 and 53 arranged in a concentric arrangement upon the upper surface of transfer plate 12. As is also seen in FIG. 5, each of pump cavities 50 through 53 defines a respective pair of apertures at each end thereof.

Returning to FIG. 2, the section view of FIG. 2 shows pump cavities 50 and 52 in section view. Pump cavity 50 is generally arcuate in shape and defines an arcuate recess 65. Pump cavity 50 further defines a groove 60 surrounding the outer edge of pump cavity 50. As is better seen in FIG. 5, pump cavity 50 further defines a pair of apertures 72 and 73 at opposite ends of recess 65. Returning to FIG. 2, aperture 72 is coupled to an angled passage 70 which extends downwardly through transfer plate 12 and communicates with fluid groove 35. Similarly, aperture 73 (seen in FIG. 5) of pump cavity 50 is coupled to groove 37 of manifold 11 by an inwardly angled passage 85. Thus, each of the apertures communicating with recess 65 of pump cavity 50 is coupled to a different one of fluid grooves 35 and 37.

Similarly, pump cavity 52 defines an arcuate shape having a surrounding groove 62 formed therein. Further, pump cavity 52 defines an arcuate recess 67 having apertures 80 and 81 (seen in FIG. 5) at opposite ends of recess 67. In a similar fabrication to pump cavity 50, each of the apertures formed in pump cavity 52 is coupled to one of fluid grooves 35 and 37 of manifold 11. More specifically, aperture 81 of pump cavity 52 is coupled to groove 37 by an angled passage 71 while aperture 80 (seen in FIG. 5) is coupled to fluid groove 35 by an outwardly angled passage 86. In further accordance with the present invention and with temporary reference to FIG. 5, it will be noted that the remaining pump cavities (pump cavities 51 and 53) are identical to pump cavities 50 and 52 and define respective aperture pairs at each end thereof. It will be understood, the similarity of pump cavities 51 and 53 to pump cavities 50 and 52 is further maintained in that apertures 76 and 84 of pump cavities 51 and 53 are coupled to fluid groove 35 of manifold 11 while apertures 77 and 85 thereof are coupled to fluid groove 37 of manifold 11. Thus each of pump cavities 50 through 53 defines an arcuate recess which is coupled to fluid grooves 35 and 37 of manifold 11.

Returning to FIG. 2, pump 10 further includes a cavity pad 90 formed of a resilient material such as resilient plastic, rubber or other suitable flexible resilient flexible material. Cavity pad 90 defines a plurality of arcuate diaphragms 92 and 94 together with diaphragms 89 and 93 (diaphragms 89 and 93 seen in FIG. 4) which are shaped, sized and positioned to correspond to the positions of pump cavities 50 through 53 (seen in FIG. 4). Diaphragm 92 extends above and generally covers pump cavity 50 defining a fluid receiving space between the underside of diaphragm 92 and recess 65 of pump cavity 50. Cavity pad 90 further includes a downwardly extending seal 91 which is received within groove 60 of pump cavity 50 to complete the isolation and fluid tight sealing of pump cavity 50 by cavity pad 90. Similarly, diaphragm 94 is positioned above pump cavity 52 such that a fluid receiving space is formed between recess 67 and the underside of diaphragm 94. By way of further similarity, diaphragm 94 further includes a resilient seal 95 received within groove 62 of pump cavity 52 to provide the fluid tight enclosure of pump cavity 52. While not seen in FIG. 2, it will be understood that diaphragms 89 and 93 (seen in FIG. 4) are identical in structure to diaphragms 92 and 94 and provide corresponding fluid tight enclosure of pump cavities 53 and 51 respectively.

Figure 4:
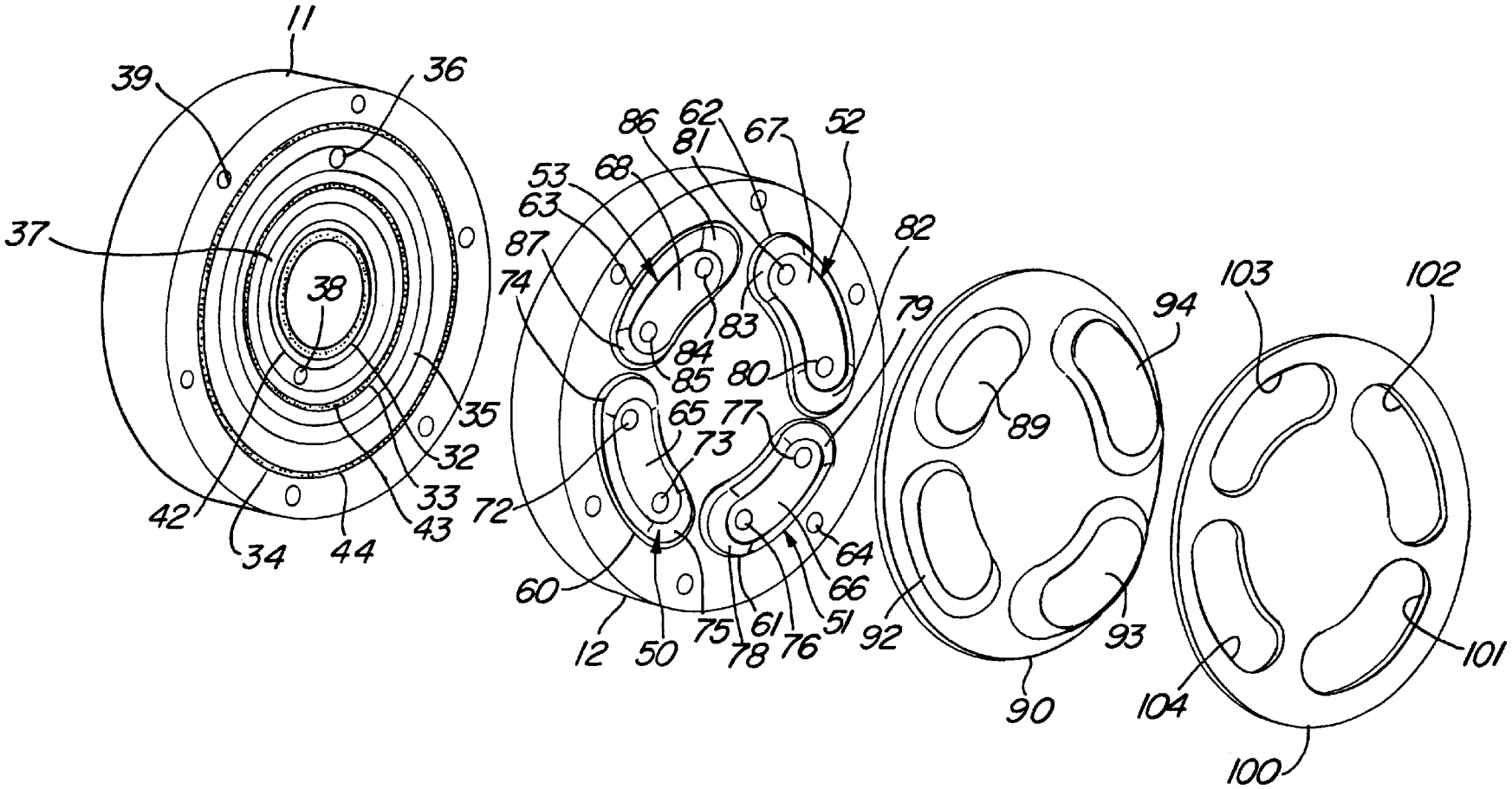
FIG. 4 sets forth a perspective assembly view of the pump cavity and manifold components of the present invention rotary cavity pump.

Pump 10 further includes a pad support plate 100 which as is better seen in FIG. 4 defines a plurality of arcuate slots 101, 102, 103 and 104 and is received above cavity pad 90 such that diaphragms 92, 93, 94 and 89 extend through respective ones of slots 101 through 104 of pad support plate 100. In the preferred fabrication of the present invention, pad support plate 100 is formed of a relatively rigid material such as metal or the like to provide support of cavity pad 90 against transfer plate 12 and to maintain the seal integrity of diaphragms 89, 92, 93 and 94 against their respective pump cavities.

Pump 10 further includes a pump body 13 defining an interior chamber 110 and a lip 111. Pump body 13 is joined to transfer plate 12 by fasteners 22 (seen in FIG. 1) such that lip 111 receives the outer portion of pad support plate 100 allowing pad support plate 100 to be forced against cavity pad 90. Pump body 13 further defines a passage 112 extending from chamber 110 and an aperture 114. Pump body 13 further includes a flange 113 for providing support for pump 10.

Pump 10 further includes a compression plate 125 having a roller support 126 received within chamber 110 of pump body 13. Compression plate 125 further includes a compression plate shaft 14 extending upwardly through passage 112 and aperture 114 to the exterior of pump body 13. A pair of conventional bearings 120 and 121 are received within passage 112 and provide rotational support for compression plate shaft 14. A compression shim 129 is positioned upon compression shaft 14 against bearing 120. A lip seal 114 defines a bore 116 and is threadably secured within aperture 114 to provide further support for compression plate shaft 14.

Figure 7C:
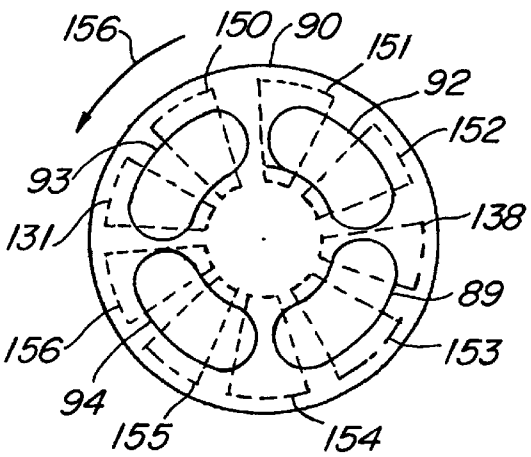
FIGS. 7A, 7B and 7C set forth simplified diagrams of the pump cavity and roller cooperation of the present invention rotary cavity pump at sequential positions of rotary actions.
Figure 7B:
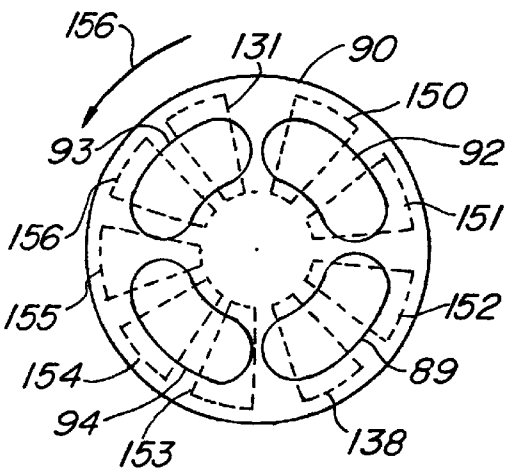
Figure 7A:
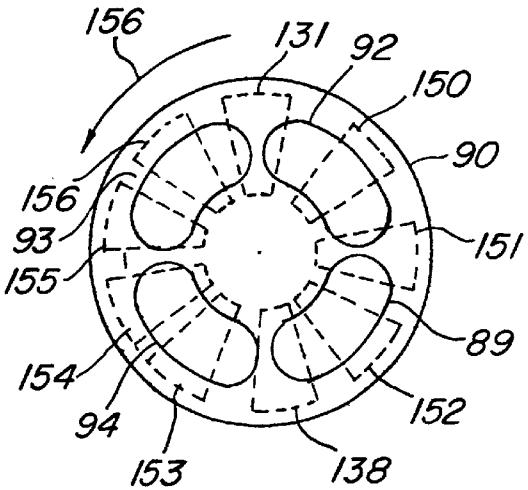

Roller support 126 supports a plurality of rollers 131, 150, 151, 152, 138, 153, 154, 155 and 156 (seen in FIG. 7A). In the section view of FIG. 2, rollers 131 and 138 are shown supported by roller support 126. It will be understood by those skilled in the art that the remaining rollers supported upon roller support plate 126 are secured and supported upon roller support 126 in the identical manner as rollers 131 and 138. Thus, the descriptions provided in conjunction with FIG. 2 regarding the support of rollers 131 and 138 will be understood to apply equally well to the support of rollers 150 through 156 seen in FIG. 7A.

Roller support 126 defines a pairs of apertures 127 and 128 which receive shaft 130. Shaft 130 in turn supports a tapered roller 131. Roller 131 is preferably supported at the angle shown and preferably defines a conical roller. However, it will be apparent to those skilled in the art from the descriptions which follow that roller 131 may alternatively be shaped in other configurations such as a cylindrical or convex profile roller as desired without departing from the spirit and scope of the present invention. In a similar fashion, roller 138 is rotatably supported upon a shaft 137 which is received within apertures 135 and 136 formed in roller support 126. Additional apertures such as apertures 140, 141 and 142 are formed in roller support 126 to support additional rollers in the manner shown in FIG. 7A. Thus, roller support 126 supports a plurality of rollers 150 through 156 in addition to rollers 131 and 138 in identical support apparatus to that shown for rollers 131 and 138. Once again, it will be noted that while the conical shape of rollers 131 and 138 as well as rollers 150 through 156 (seen in FIG. 7A) utilizes a generally tapered conical shape, other shapes such as cylindrical or convex rollers may be utilized upon roller support 126 without departing from the spirit and scope of the present invention. In addition, roller support 126 may be fabricated as an undulating plate having a plurality of downwardly extending undulations in the manner shown in FIG. 10 in place of the rollers shown in the embodiments of FIGS. 2 and 7A.

In operation, fluid ports 30 and 31 are operatively coupled to a fluid system within which pump 10 is to be operated. As mentioned above, pump 10 is capable of operation in either direction by rotation of compression plate shaft 14 in either rotational direction. For example, rotation of compression plate shaft 14 in one direction facilitates utilization of fluid port 30 as an input port coupled to a fluid reservoir leaving fluid port 31 as a high pressure side output port coupled to the desired fluid utilization device. Conversely, rotation of compression plate shaft 14 in the opposite direction causes fluid to be drawn into fluid port 31 and expelled at an increased pressure at fluid port 30. Thus, for example, with compression plate shaft 14 rotated in a first direction such that fluid port 30 becomes the input port for pump 10, the resilience of diaphragm 92 draws a quantity of fluid inwardly through fluid port 30 into fluid groove 35 and upwardly through passage 70 into recess 65 and fills the space defined between recess 65 and the underside of diaphragm 92. Because the remaining resilient diaphragms within cavity pad 90 (diaphragms 93, 94 and 89 seen in FIG. 4) operate in a similar fashion, additional fluid is drawn through fluid port 30 into fluid groove 35 and upwardly through the respective passages for each diaphragm and pump cavity combination to fill each pump cavity with a quantity of fluid drawn through fluid port 30.

Thus, the resilience of each cavity pad is operative to draw fluid upwardly from fluid groove 35 upwardly into its respective pump cavity after which the rotation of roller support 126 causes the various rollers supported thereon to compress and roll across each diaphragm to captivate fluid within the pump cavities and force it outwardly through the various apertures provided within the pump cavity recesses into fluid groove 37 and outwardly through fluid port 31.

Figure 11A:
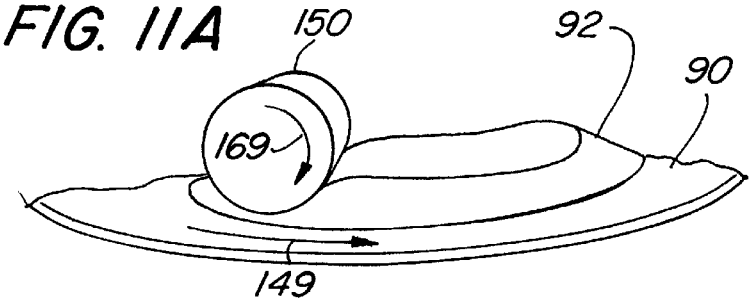
FIGS. 11A, 11B and 11C set forth sequential partial perspective views of an exemplary pump cavity and roller constructed in accordance with the present invention at selected points in its operational cycle.
Figure 11B:
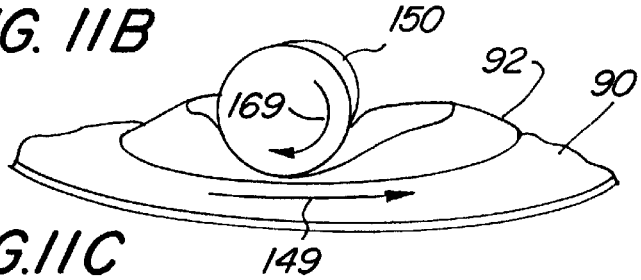
Figure 11C:
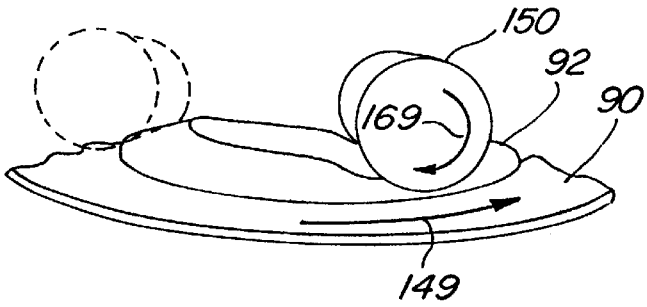

FIGS. 11A through 11C illustrate the action of a typical roller upon a typical cavity pad as roller support 126 is rotated. To facilitate an understanding of the basic action of the rotary drive cavity pump of the present invention, FIGS. 11A through 11C show a single roller 150 operative upon a single diaphragm 92. As will be understood from the descriptions which follow, the preferred embodiment of the present invention utilizes a substantial number of rollers operative upon the various diaphragms within the cavity pad to provide simultaneous actions within each of the multiple diaphragms within the cavity pad. However, the action of each diaphragm and roller combination upon their respective pump cavities is best understood by the simplified illustrations of FIGS. 11A through 11C. Thus, with temporary attention to FIG. 11A, cavity pad 90 supports a resilient diaphragm 92 which is operated upon a typical roller 150. It will be understood that roller 150 is movably supported upon roller support 126 in the manner illustrated in FIG. 2. The cooperation between roller 150 and diaphragm 92 is provided as roller 150 if rolled across diaphragm 92 in the direction indicated by arrow 149. The position of roller 150 is selected to cause roller 150 to deform diaphragm 92 and force it downwardly upon its underlying pump cavity. Thus, as roller 150 initially rolls upon the end portion of diaphragm 92, the underlying aperture (such as aperture 72 shown in FIG. 2) is closed or blocked by the intrusion of under portion 96 of diaphragm 92 (also seen in FIG. 2). Thereafter, as roller 150 is moved in the direction indicated by arrow 149, it rolls in the direction indicated by arrow 169 upon diaphragm 92 deforming diaphragm 92 and captivating a quantity of fluid within the interior of diaphragm 92.

FIG. 11B shows the progress of roller 150 in the direction indicated by arrow 149 as roller 150 continues to be moved and rolls across diaphragm 92 in the direction indicated by arrow 169. The deformed portion of diaphragm 92 has now moved in the direction of roller motion (arrow 149) causing a portion of the fluid captivated within diaphragm 92 to be forced from the underlying pump cavity (pump cavity 50 seen in FIG. 2). The fluid forced from the underlying pump cavity flows outwardly from the aperture formed therein (aperture 73 seen in FIG. 5). Because aperture 73 is coupled to fluid groove 37 (seen in FIG. 2), the fluid is then able to flow outwardly through fluid port 31 (also seen in FIG. 2).

FIG. 11C shows the further movement of roller 150 in the direction indicated by arrow 149 as roller 150 rotates in the direction indicated by arrow 169 upon diaphragm 92 of cavity pad 90. At the point shown in FIG. 11C, the deformed portion of diaphragm 92 caused by roller 150 now closes aperture 73 of pump cavity 50 (seen in FIG. 5) completing the expulsion of fluid from diaphragm 92. Further shown in FIG. 11C, the movement of roller 150 to the end portion of diaphragm 92 allows the resilience of diaphragm 92 to restore the normal shape of diaphragm 92 to the portion thereof which is not deformed by roller 150. This resilient restoration of its normal shape by diaphragm 92 draws a second quantity of fluid upwardly into the underlying pump cavity (pump cavity 50 seen in FIG. 2) thereby preparing diaphragm 92 for the action of the next roller approaching diaphragm 92 shown in dashed-line representation.

It will be understood that the illustrative action of roller 150 upon diaphragm 92 shown in FIGS. 11A through 11C is repeatedly carried forward by the remaining diaphragm and rollers within pump 10 as compression plate 125 continues to rotate roller support 126. It will be recalled that FIGS. 11A through 11C are provided primarily to illustrate the principle action of a given roller upon a give diaphragm within the present invention system. It must be understood that the preferred embodiment of the present invention utilizes a substantial number of rollers operative upon a plurality of diaphragms and pump cavities to provide a more useful pump and more desirable pump characteristics. Thus, once the illustrative action of FIGS. 11A through 11C is understood, the complete operation of the present invention pump may be appreciated by reference to the following figures such as FIGS. 7A through 7C as well as FIGS. 8 and 9 which show various operative combinations of pump cavities and diaphragms together with respective roller configurations. It will be apparent that in a more typical application of the type contemplated in the present invention, each diaphragm is likely to be acted upon by two or more rollers at any given time.

Figure 3:
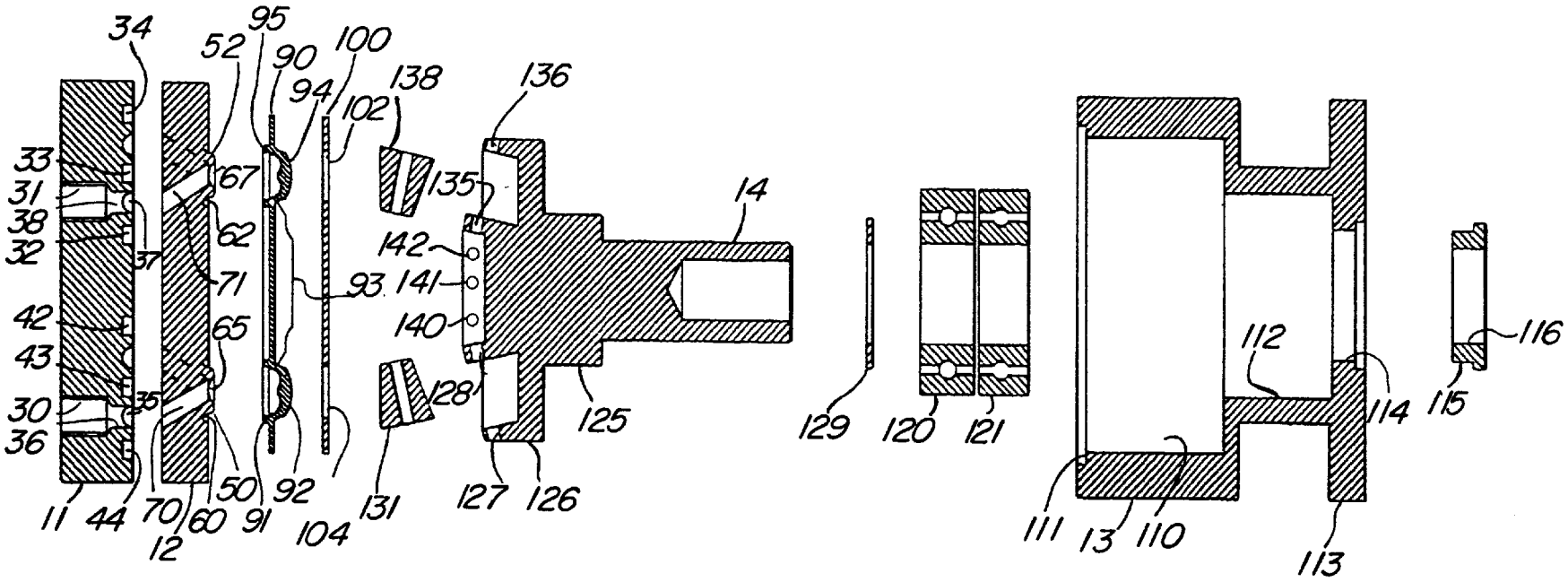
FIG. 3 sets forth a section view assembly drawing of the present invention rotary cavity pump.

FIG. 3 sets forth a section assembly view of pump 10. As described above, pump 10 includes a pump body 13 defining a chamber 110 having a lip 111 formed therein. Pump body 13 further defines a flange 113 having an aperture 114 formed therein. A lip seal 115 having an aperture 116 formed therein is secured within aperture 114 by conventional attachments such as threaded attachment. Pump 10 further includes a pair of bearings 120 and 121 received within passage 112 of pump body 13. A compression plate 125 having a roller support 126 and a compression plate shaft 14 is received within pump body 13 such that shaft 14 passes through aperture 116 of lip seal 115 and is supported by bearings 120 and 121. Compression plate 125 includes a roller support 126 having a plurality of outer apertures such as apertures 127 and 136 together with interior apertures such as apertures 128, 135, 140, 141 and 142. A plurality of tapered rollers such as rollers 131 and 138 are rotatably supported upon roller support 126 in the manner shown in FIG. 2.

Pump 10 further includes a manifold 11 having a pair of fluid ports 30 and 31 formed therein. Manifold 11 further defines a pair of concentric fluid grooves 35 and 37 together with a plurality of seal grooves 32, 33 and 34. A plurality of resilient seals 42, 43 and 44 are received within grooves 32, 33 and 34 respectively. Fluid port 30 is coupled to groove 35 by a passage 36 while fluid port 31 is coupled to groove 37 by a passage 38. Pump 10 further includes a transfer plate 12 having a plurality of pump cavities 50 through 53 (pump cavities 51 and 53 seen in FIG. 5). Pump cavity 50 defines a recess 65 coupled to an angled passage 70 while pump cavity 52 defines a recess 67 coupled to an angled passage 71. Pump cavity 50 further defines a surrounding groove 60 while pump cavity 52 defines a surrounding groove 62. A cavity pad 90 is formed of a flexible resilient material and defines a plurality of diaphragms 92, 93, 94 and 89 (diaphragm 89 seen in FIG. 4). Diaphragm 92 defines an encircling seal 91 received within groove 60 of pump cavity 50 while diaphragm 94 defines an encircling seal 95 received within groove 62 of pump cavity 52. Pump 10 further includes a pad support plate 100 preferably formed of a rigid material such as metal or the like defining a plurality of apertures 101 through 104 (apertures 101 and 103 seen in FIG. 4). Pad support plate 100 is received upon cavity pad 90 such that the respective apertures formed therein surround respective diaphragms and maintain the fluid tight integrity of each diaphragm against its underlying pump cavity.

FIG. 4 sets forth a perspective assembly view of manifold 11, transfer plate 12, cavity pad 90 and pad support plate 100. As described above, manifold 11 is generally cylindrical and defines a pair of fluid grooves 35 and 37. Fluid groove 35 defines a passage 36 which communicates fluid groove 35 with fluid port 30 while fluid groove 37 defines a passage 38 which communicates groove 37 with fluid port 31. A plurality of seal grooves 32, 33 and 34 receive respective resilient seals 42, 43 and 44 and provide isolation between fluid grooves 35 and 37. A plurality of apertures 39 are formed in manifold 11 to receive conventional fasteners in the manner shown in FIG. 1.

Transfer plate 12 defines a generally cylindrical member having a plurality of apertures 64 aligned with apertures 39 of manifold 11. Apertures 64 receive fasteners in the manner indicated in FIG. 1. Transfer plate 12 further defines a plurality of pump cavities 50, 51, 52 and 53 each identically shaped and each defining generally arcuate members concentrically arranged upon a common surface of transfer plate 12. Each of pump cavities 50 through 53 defines an arcuate recess having a pair of apertures formed therein. Thus, pump cavity 50 defines an arcuate shape having a recess 65 formed therein. Pump cavity 50 further includes a surrounding groove 60 and a pair of inclined ramps 74 and 75 positioned at opposite ends of pump cavity 50. A pair of apertures 72 and 73 are formed at opposite ends of arcuate recess 65. Similarly, pump cavity 51 defines a surrounding groove 61 together with end ramps 78 and 79 and an arcuate recess 66. Recess 66 further defines apertures 76 and 77. Pump cavity 52 defines a surrounding groove 62, a pair of ramp portions 82 and 83, an arcuate recess 67 and apertures 80 and 81. Finally, pump cavity 53 defines a surrounding groove 63, end ramps 86 and 87 and an arcuate recess 68 having apertures 84 and 85 formed therein. In accordance with the present invention, apertures 72, 76, 80 and 84 of pump cavities 50, 51, 52 and 53 respectively are coupled by respective passages to fluid groove 35 while apertures 73, 77, 80 and 85 of pump cavities 50, 51, 52 and 53 are coupled by respective angle passages to fluid groove 37. Thus, each of pump cavities 50 through 53 has one aperture coupled to fluid groove 35 and the remaining aperture coupled to fluid groove 37.

Cavity pad 90 is preferably formed of a resilient material such as resilient plastic or rubber or the like and defines a plurality of resilient diaphragms 92, 93, 94 and 89 respectively shaped and positioned to overlie pump cavities 50 through 53 respectively. A pad support plate 100 preferably formed of a rigid material such as metal or the like defines a plurality of elongated arcuate slots 101, 102, 103 and 104. Pad support plate 100 is positioned upon cavity pad 90 such that each of the diaphragms upon cavity pad 90 extend through a respective one of slots 101 through 104.

FIG. 5 sets forth a top plan view of transfer plate 12. Transfer plate 12 defines a plurality of pump cavities 50, 51, 52 and 53 having generally arcuate shapes and concentrically arranged upon the transfer plate. Pump cavity 50 defines an arcuate recess 65 having an aperture 72 formed at one end and an aperture 73 at the opposite end. A pair of ramp portions 74 and 75 are formed at opposed ends of pump cavity 50. A groove 60 surrounds pump cavity 50. Pump cavity 51 is identical to pump cavity 50 and defines a surrounding groove 61, a pair of ramps 78 and 79 at opposed ends and an arcuate recess 66. A pair of apertures 76 and 77 are formed at opposite ends of recess 66. Pump cavity 52 is identical to pump cavities 50 and 51 and defines a surrounding groove 62 an arcuate recess 67 and end ramp portions 82 and 83. Pump cavity 52 further defines apertures 80 and 81 at opposite ends of recess 67. Pump cavity 53 is identical to pump cavities 50 through 52 and defines a surrounding groove 63, a pair of ramp portions 86 and 87 and an arcuate recess 68. A pair of apertures 85 and 84 are formed at opposed ends of arcuate recess 68. To provide the operative fluid coupling of the present invention pump, apertures 72, 76, 80 and 84 of pump cavities 50, 51, 52 and 53 respectively are coupled to fluid groove 35 of manifold 11 (seen in FIG. 4) while apertures 73, 77, 81 and 85 of pump cavities 50, 51, 52 and 53 are coupled to fluid groove 37 of manifold 11 (seen in FIG. 4).

Figure 6:
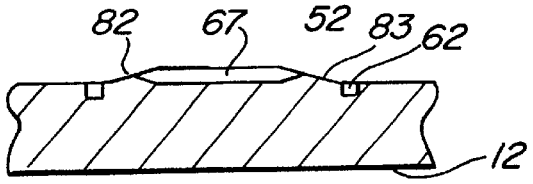
FIG. 6 sets forth a partial section view of a portion of the transfer plate shown in FIG. 5 taken along section lines 6—6 therein.

FIG. 6 sets forth a partial section view of transfer plate 12 taken along section line 6—6 in FIG. 5. As described, transfer plate 12 is a generally cylindrical member supporting a plurality of pump cavities each of which is identical which are arranged concentrically upon the upper surface of transfer plate 12. As is seen in the section view of FIG. 6, transfer plate 12 defines a pump cavity 52 having a recess 67 formed therein. As is also seen in FIG. 6, pump cavity 52 defines a surrounding groove 62 which receives a downwardly extending seal supported upon cavity pad 90 in the manner shown in FIG. 2. Of importance to note in FIG. 6 is the presence of inclined ramps 82 and 83 on each end of pump cavity 52. The function of ramps, such as ramps 82 and 83 is to provide a transition surface against which the rollers of the present invention pump may be brought into contact with the deformable diaphragm which is positioned above the pump recess and which encloses and seals against the pump recess in the manner shown in FIG. 2. The presence of ramps such as ramps 82 and 83 of pump cavity 52 allows the initial positioning of the deforming diaphragm of cavity pad 90 (seen in FIG. 4) to be compressed against pump cavity 52 in the desired manner and to facilitate the compression of the diaphragm into recess 67. It will be recalled that the compression of the underside of the diaphragm above the pump cavity provides the dual function of closing off or blocking the underlying aperture within the pump cavity recess and the captivation of a volume of fluid between the pump cavity recess and the diaphragm. It will be further recalled that this trapped volume is moved into the output aperture of the pump cavity recess as the roller transitions across the diaphragm in the manner illustrated in FIGS. 11A through 11C.

FIGS. 7A, 7B and 7C set forth sequential diagrams illustrating the movement of the plurality of rollers carried by compression plate 125 (seen in FIG. 3) as rotational power is applied to the present invention pump. The diagrams shown in FIGS. 7A, 7B and 7C show a sequence of rotational positions as the compression plate is rotated to move the rollers in a selected direction indicated by arrow 156. It will be recalled however, that the present invention pump is not limited to either direction of rotation and is capable of operation in either the direction indicated by arrow 156 in FIGS. 7A through 7C or in the opposite direction thereto. It should also be recalled that the present invention pump may be operated in either a continuous rotation or in an incremental angular movement of the pump rollers to provide a precise metering operation.

More specifically, FIG. 7A shows cavity pad 90 having diaphragms 92, 93, 94 and 89 formed thereon. In dash-lined representation, a plurality of tapered rollers 131, 150, 151, 152, 138, 153, 154, 155 and 156 are positioned upon cavity pad 90 in the anticipated operation of pump 10 described above. The initial selected position of rollers shown in FIG. 7A is purely arbitrary and is chosen for purposes of illustration. In essence, the present invention pump does not require the initial positioning of the rollers in any particular manner to initiate either metered or steady state pumping operation.

In operation, with rollers 131, 138 and 150 through 156 positioned as shown with respect to diaphragms 92, 93, 94 and 89, rotation in the direction indicated by arrow 156 initiates a pumping action. It will be noted, that each of the rollers is operative upon the underlying diaphragm at a slightly different point of the pump operational cycle. For example, roller 131 is essentially between diaphragms and has completed operation upon diaphragm 92 and is initiating action upon diaphragm 93. Roller 150 is at a mid point in an operative cycle upon diaphragm 92 having moved to the approximate mid point thereof. At this point, and with rotation in the direction of arrow 156, roller 150 is operating to expel the captivated fluid ahead of roller 150 within diaphragm 92 through the exit aperture of the underlying pump cavity in the manner described above. Conversely, roller 151 is between diaphragms 92 and 89 and has completed operation upon diaphragm 89 and is initiating action upon diaphragm 92. The various remaining rollers are similarly distributed upon their underlying diaphragms at different points at their respective operative cycles.

FIG. 7B shows cavity pad 90 having diaphragms 92, 93, 94 and 89 together with rollers 131, 138 and 150 through 156 having been rotated in the direction of arrow 156 by approximately thirty degrees. At this point, comparison of FIGS. 7A and 7B shows that roller 131 has initiated its operative cycle upon diaphragm 93 captivating fluid therein while roller 150 has virtually completed its operative stroke upon diaphragm 92. Further, roller 151 has moved upon diaphragm 92 and captivated a quantity of fluid ahead of roller 151 within diaphragm 92. Similarly, the remaining rollers of pump 10 have undergone corresponding angular movements and advanced within their respective cycles upon their respective underlying diaphragms.

FIG. 7C shows cavity pad 90 having cavity pad 92, 93, 94 and 89 formed thereon together with roller 131, 138 and 150 through 156 operative upon their respective diaphragms as rotation in the direction of arrow 156 continues. At the operative point illustrated in FIG. 7C, each roller has advanced approximately ninety degrees from the rotational position shown in FIG. 7A. Thus, roller 150 has initiated the captivation of fluid within diaphragm 93 and is advancing the captivated fluid through the output aperture in the underlying pump cavity (seen in FIG. 4). Similarly, roller 151 has virtually completed its operative cycle upon diaphragm 92 and is being roller from diaphragm 92. Correspondingly, roller 152 has transitioned from its previous position upon diaphragm 89 and has moved upon diaphragm 92 captivating a quantity of fluid therein which is being expelled through the output aperture in the underlying pump cavity. Similarly, the remaining rollers shown in FIG. 7C have undergone corresponding operational rotations and have transitioned through their respective operative cycles upon underlying diaphragms.

It is important to note that the present invention pump is capable of operation either in incremental motion such as illustrated in FIGS. 7A, 7B and 7C or in a sequential motion which continuously moves the plurality of rollers upon the plurality of diaphragms to provide a substantially continuous pumping action. It will be further noted that the cooperation of each roller as it moves upon its respective diaphragm provides the required closure and opening of the input and output apertures in the underlying pump cavity through the deformation of the diaphragm and without the need for operative input/output or so-called single direction valves to provide a net flow of fluid through the pump.

It should be understood that the present invention pump has thus far been illustrated in an embodiment which utilizes four diaphragms and cooperating pump cavities together with nine rollers supported upon compression plate 125. However, a variety of operative combinations of different numbers of diaphragms and cooperating pump cavities together with different numbers of rollers operative upon them may be utilized without departing from the spirit and scope of the present invention. For example, it has been found that increasing the number of rollers operative upon the diaphragm tends to reduce the pulsation of fluid flow. Similarly, an increased number of pump cavities and diaphragms is also generally operative to further smooth the pump flow. It has also been found that the use of rollers in operation upon the diaphragm may be replaced by an undulating compression plate such as that shown in FIG. 10 without departing from the spirit and scope of the present invention. It has been further found that various combinations of diaphragms and rollers may be utilized without departing from the spirit and scope of the present invention. Accordingly, FIGS. 8 and 9 set forth below show alternative roller and diaphragm combinations which are provided for illustration but which should be in no way be taken as limitation upon the combinations with which the present invention pump may operate.

Figure 8:
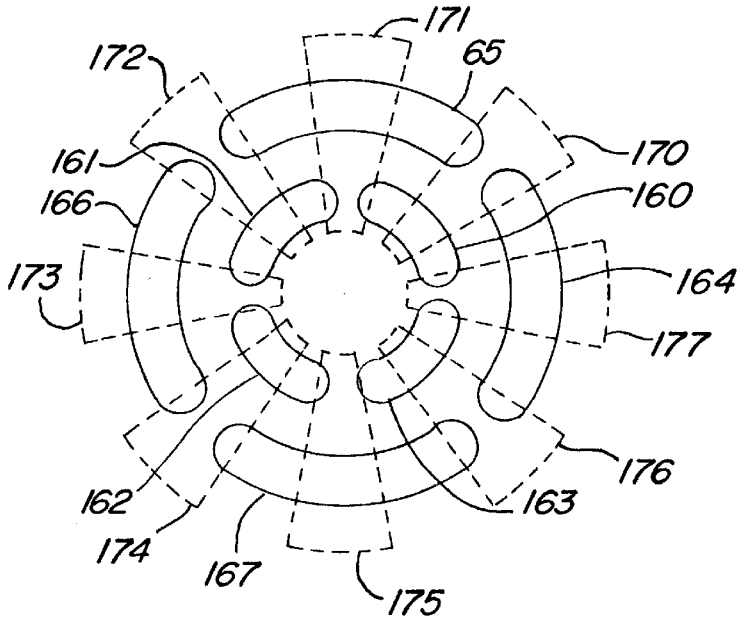
FIG. 8 sets forth a simplified view of the pump cavity and roller components of an alternative embodiment of the present invention rotary cavity pump.
Figure 9:
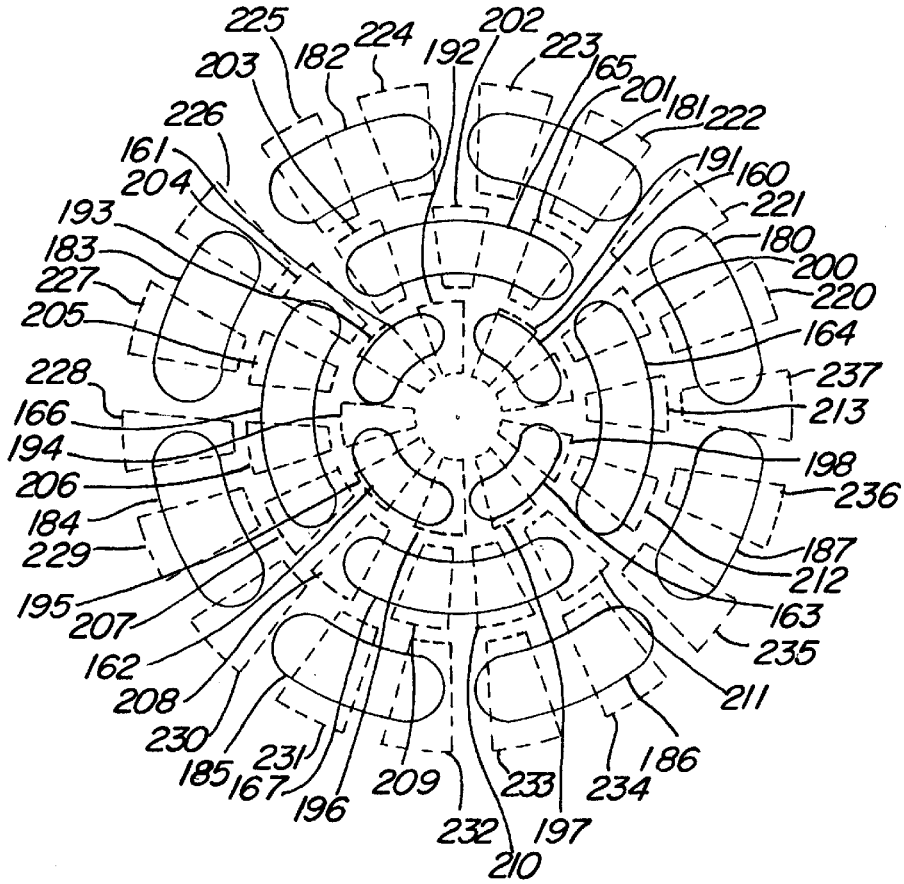
FIG. 9 sets forth a simplified drawing of the pump cavities and drive rollers of a still further alternate embodiment of the present invention rotary cavity pump.

FIGS. 8 and 9 set forth alternative combinations of diaphragms and roller operative to illustrate flexibility of design of the present invention. It will be understood that still different combinations may be utilized without departing from the spirit and scope of the present invention. By way of overview, FIG. 8 shows multiple concentric rings of diaphragms operated upon by radially disposed common rollers. In contrast, FIG. 9 shows multiple concentric rings of diaphragms operated upon by multiple concentric rings of rollers.

More specifically, FIG. 8 sets forth a simplified diagram of a cavity pad forming an alternate embodiment of the present invention in which an inner circle of diaphragms 160, 161, 162 and 163 is further surrounded by an outer ring of diaphragms 164, 165, 166 and 167. A plurality of tapered rollers 170 through 177 are rotatably supported in the manner described above and are commonly operative upon diaphragms 160 through 163 and 170 through 177. The operation of rollers 170 through 177 upon the pluralities of diaphragms is substantially the same as described above in FIGS. 7A through 7C and FIGS. 11A through 11C with the difference being the operation of each roller upon diaphragms within each of the two diaphragm rings. In all other respects however, the operation of the embodiment shown in FIG. 8 is substantially the same as the above identified embodiment shown in FIGS. 1 through 7 with corresponding changes to the number and configuration of pump cavities upon the transfer plate and the number of fluid grooves in the manifold.

FIG. 9 sets forth a still further alternate embodiment in which three concentric rings of diaphragms are positioned upon a common cavity pad. Thus, an inner plurality of diaphragms 160 through 163 is encircled by an intermediate plurality of diaphragms 164 through 167. Thus, it will be noted that the interior and intermediate pluralities of diaphragms in FIG. 9 are substantially the same as the diaphragms shown in FIG. 8. FIG. 9 further adds an outer plurality of diaphragms 180 through 187 which encircle diaphragms 164 through 167. It will be understood that in the embodiment of FIG. 9 each of the pluralities of diaphragms is supported in cooperation with a corresponding pump cavity in the manner described above.

In contrast to the embodiment of FIG. 8, the embodiment of FIG. 9 employs a plurality of concentrically arranged roller groups operative upon each of the pluralities of diaphragms. It will be understood that the pluralities of rollers shown in the embodiment of FIG. 9 are supported in a similar manner to that described above for pump 10 with the necessary adjustments of structure to facilitate multiple concentric roller arrangements. Thus, in the embodiment of FIG. 9, a plurality of rollers 190 through 198 are supported upon the interior diaphragm group and operative thereon. An intermediate plurality of rollers 200 through 213 are supported upon and operative in cooperation with diaphragms 164 through 167 which form the intermediate diaphragm group. Finally, a plurality of rollers 220 through 227 are supported upon an operative in cooperation with the outer group of diaphragms formed by diaphragms 180 through 187.

Once again, it will be apparent that the operations of each plurality of rollers upon its associated plurality of diaphragms in the embodiment of FIG. 9 is substantially identical to the above described operation of pump 10. Thus, as rollers 190 through 198, 200 through 213 and 220 through 237 are rotated the above described pumping action takes place simultaneously in the pluralities of diaphragms in the embodiment of FIG. 9. It will be apparent to those skilled in the art, that the pluralities of diaphragms and rollers contribute to the elimination of any discernible pulsation within the fluid flow of the present invention pump and for the most part operate to increase the flow rate of the pump as each pump cavity and diaphragm cooperate in an generally parallel flow contribution.

Figure 10:
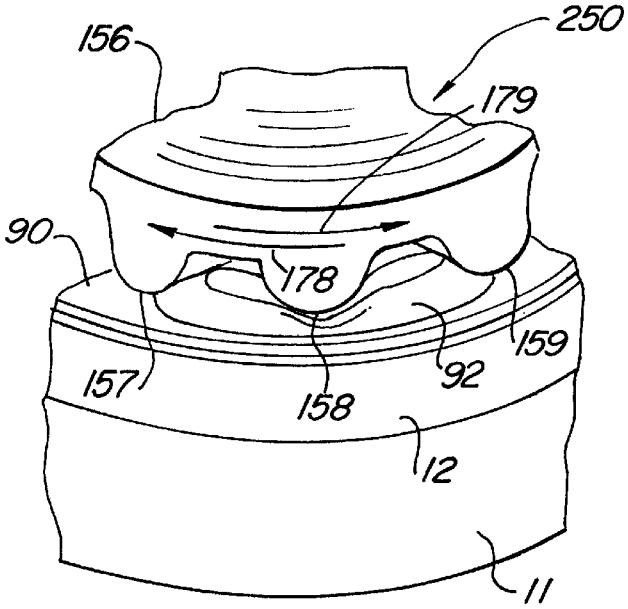
FIG. 10 sets forth a partial perspective view of a still further alternate embodiment of the present invention rotary cavity pump utilizing an undulating plate for the rotating compression plate of the present invention pump.

FIG. 10 sets forth a partial perspective view of a still further alternate embodiment of the present invention generally referenced by numeral 250. Pump 250 will be understood to be substantially identical to the above described pumps and particularly correspond most closely to pump 10 described above. It will be understood however, that pump 250 may operate using multiple concentric arrangements of diaphragms similar to those shown in FIGS. 8 and 9. In particular, pump 250 utilizes manifold 11 and transfer plate 12 supporting cavity pad 90 in the manner described above. In further similarity to the above described embodiment, cavity pad 90 supports a plurality of diaphragms including diaphragm 92. While not seen in FIG. 10, it will be understood that transfer plate 12 is identical to that described above and thus supports a plurality of pump cavities. Compression plate 156 is substantially similar to compression plate 125 described above with the substitution of an undulating mechanism in place of the plurality of rollers shown in compression plate 125. Thus, in compression plate 156 the plurality of rollers operative upon the pump diaphragms is replaced by a plurality of fixed undulations such as undulations 157, 158 and 159. In operation however, the net effect upon diaphragm 92 is shown to be substantially the same as that shown in FIGS. 11A through 11C as compression plate 156 is rotated in either direction 178 or 179. The same fluid trapping and moving action is produced within diaphragm 92 by movement of the undulations across the diaphragm as described above.

FIGS. 11A, 11B and 11C provide sequential illustrations of the operation of a single roller upon a single diaphragm to illustrate the above described pump in operation. In the descriptions set forth herein it will be understood that in some instances the operative combination of a pump cavity and diaphragm are referred to as "pump segments". Thus, a general description of the structure of the present invention pump may include reference to a plurality of pump segments which will be understood to refer to a plurality of pump cavities and resilient diaphragms covering the pump cavities as well as the seal structure used to maintain the fluid type seal between the pump cavity and the diaphragm. It will also be understood, that FIGS. 11A through 11C shown a single roller operative upon a single diaphragm purely for illustration of the operative principle by which the present invention pump operates through a plurality of rollers operating upon a plurality of diaphragms. Thus, in FIGS. 11A, 11B and 11C a cavity pad 90 supports a resilient flexible diaphragm 92 which will be understood to overlie a cooperating pump cavity in the manner described above. Similarly, FIGS. 11A through 11C show a single roller 150 rotatably supported upon cavity pad 90 in the manner described above.

In FIG. 11A, roller 150 is initially rolled upon diaphragm 92 deforming one end of diaphragm 92 and advancing upon the diaphragm as roller 150 is advanced in the direction indicated by arrow 149 and as it rolls in the direction indicated by arrow 169. At the point shown in FIG. 11A, roller 150 has deformed diaphragm 92 sufficiently to provide closure of the underlying aperture within the cooperating pump cavity (shown in FIG. 4). Correspondingly a quantity of fluid is now trapped within the interior of diaphragm 92.

In FIG. 11B, roller 150 continues to rotate in the direction of arrow 169 and advance in the direction of arrow 149 and thereby expels a quantity of trapped fluid outwardly through the remaining aperture within the underlying pump cavity (aperture 73 in pump cavity 50 seen in FIG. 4). Further, the resilience of diaphragm 92 is operative behind roller 150 to begin restoring the shape of diaphragm 92 behind roller 150 and thereby draw fluid upwardly through the now open aperture in pump cavity 50 (aperture 72 seen in FIG. 4). Thus, as roller 150 continues to advance, diaphragm 92 begins refilling behind roller 150.

In FIG. 11C, roller 150 has continued to rotate in the direction indicated by arrow 169 and advance in the direction indicated by arrow 149 to a point where the expulsion of fluid by roller 150 is complete and roller 150 now forces diaphragm 92 downwardly to provide closure of aperture 73 of pump cavity 50 (seen in FIG. 4). The remainder of diaphragm 92 behind roller 150 has substantially restored its normal configuration due to its resiliency and has substantially refilled with fluid. A dashed-line representation of the next roller in the sequences shown in FIG. 11C for illustration.

Once again, it will understood that the illustration shown in FIGS. 11A through 11C is highly simplified to enable a clear illustration of the operative principles of the present invention pump.

Figure 12:
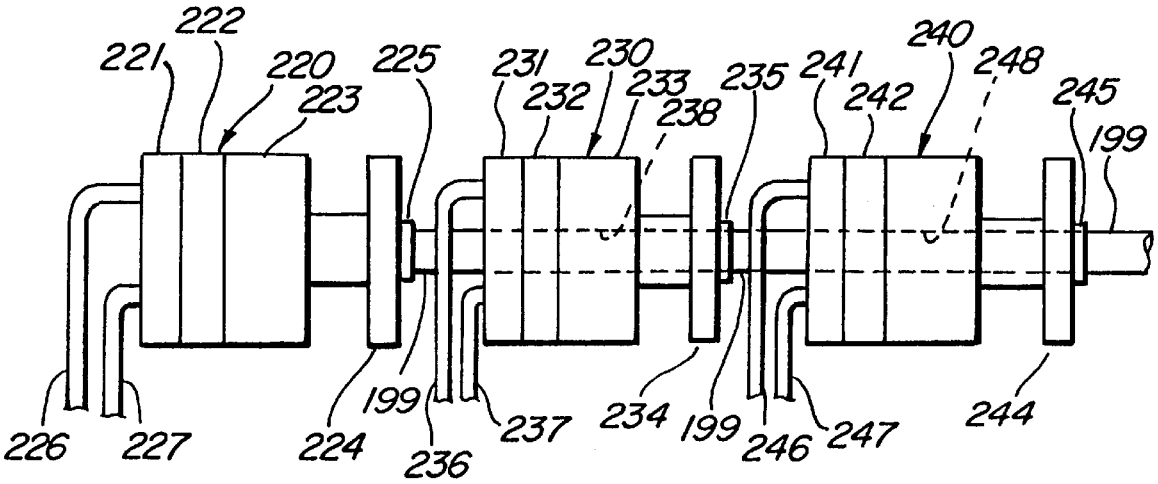
FIG. 12 sets forth a side elevation view of a plural-pump common-drive shaft embodiment of the present invention.

FIG. 12 sets forth a side elevation view of a still further alternate embodiment of the present invention in which a plurality of pumps 220, 230 and 240 are coupled in an in-line configuration and are driven by a single common drive shaft 199. Drive shaft 199 is operatively coupled to a source of rotational power such as a motor drive or the like (not shown). Pump 220 is identical to the above-described pumps and may for example conform to pump 10 shown in FIG. 1. Thus, pump 220 includes a manifold 221, a transfer plate 222 and a pump body 223 secured together in the manner described above. In further accordance with the above-described pumps, pump 220 includes an input coupling 226 and an output coupling 227. Pump body 223 further includes a flange 224 and a shaft 225 extending therefrom. In accordance with the embodiment of the FIG. 12, a drive shaft 199 is joined to shaft 225 to operate pump 220.

Pumps 230 and 240 are substantially identical to pump 220 and the above-described pumps with the exception that pumps 230 and 240 define internal center bores 238 and 248 respectively which extend through the entire pump structures and which are formed by center apertures in the structural components of each pump. The purpose of bores 238 and 248 is to facilitate the extension of common power shaft 199 through pumps 230 and 240 to provide the serial coupling.

More specifically, pump 230 includes a manifold 231 secured to a transfer plate 232 which in turn is secured to a pump body 233. Pump body 233 supports a flange 234. A shaft 235 extends through flange 234 and is joined to common shaft 199. A pair of couplers 236 and 237 are coupled to manifold 231 to provide fluid coupling into and out of pump 230.

Similarly, pump 240 includes a manifold 241, a transfer plate 242 and a pump body 243 supporting a flange 244. A shaft 245 extends through flange 244 and is secured to common drive power shaft 199. Couplers 246 and 247 provide fluid coupling into and outwardly from pump 240.

It will be understood that shafts 225, 235 and 245 of pumps 220, 230 and 240 correspond to shaft 14 (seen in FIG. 3) of pump 10 and provide the rotatable element within each of pumps 220, 230 and 240. The advantage of the serial coupling of plural pumps shown in the embodiment of FIG. 12 is found primarily in the ability to synchronize the operation of all three pumps and utilize a single common drive power source operative upon shaft 199. It will be apparent to those skilled in the art that while a plurality of three serially coupled pumps is shown in FIG. 12, the present invention embodiment of FIG. 12 is not limited to three pumps but may in fact use virtually any combination or plurality of pumps.

Figure 13:
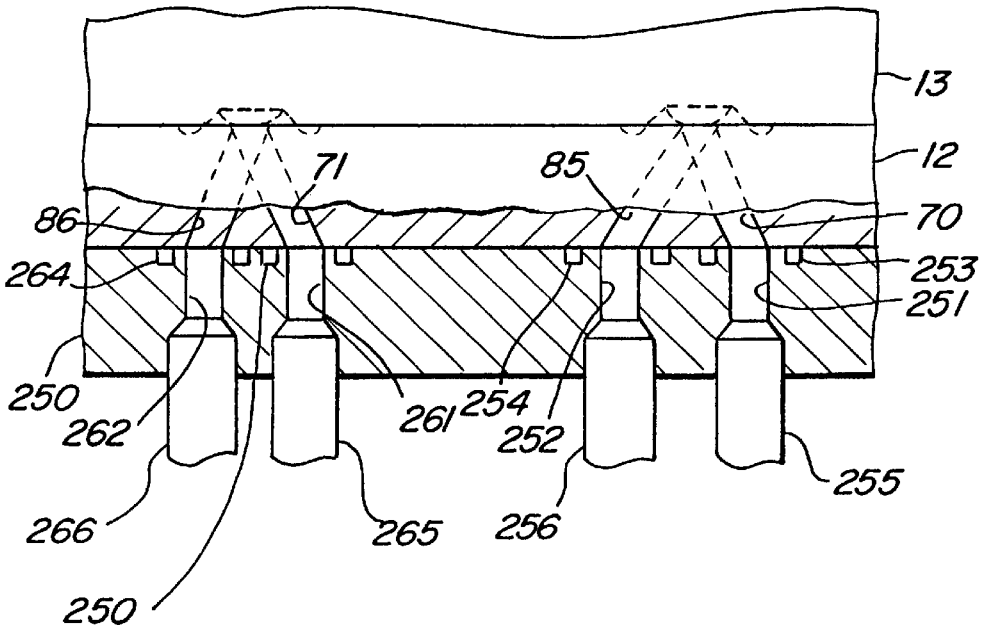
FIG. 13 sets forth a partial section view of an alternate embodiment of the present invention pump.

FIG. 13 sets forth a partial section view of a still further alternate embodiment of the present invention pump generally referenced by numeral 250. By way of overview, the distinguishing characteristic of pump 250 is the provision of parallel independent fluid flow and processing operable within a single pump housing. It will be recalled from the above-described structure shown in FIGS. 1 through 11 that each pump cavity within the transfer plate such as pump cavity 50 within transfer plate 12 of pump 10 (seen in FIG. 4) includes a pair of fluid passages to be utilized as input and output fluid passages. It will be further recalled and with continued reference to FIG. 4 that the passages within transfer plate 12 are angled to provide a coupling to fluid grooves 35 and 37 within manifold 11. Thus, in the embodiments described above such as the embodiment of FIG. 4, each of the pump cavities are operative to provide a combined flow which is collected within manifold 11.

Returning to FIG. 13, the embodiment shown provides a pump 250 which is substantially identical to the above-described pumps such as pump 10 with the exception that manifold 250 has been substituted for manifold 11 (seen in FIG. 4). The overall function of manifold 250 is to provide independent fluid couplings between the two passages within each pump cavity of the pump. In this manner, a plurality of independent isolated fluid pumping mechanisms are provided within a common pump housing.

More specifically, pump 250 includes a pump body 13 and a transfer plate 12 configured in the manner described above for pumps such as pump 10. A manifold 250 which replaces manifold 11 is secured to transfer plate 12 and provides the distinct operation of the embodiment of FIG. 13. Thus, manifold 250 includes a pair of fluid passages 251 and 252 each surrounded by annular seals 253 and 254 respectively. Fluid passage 251 is aligned with passage 70 of transfer plate 12 while fluid passage 252 is aligned with fluid passage 85 of transfer plate 12. A pair of couplers 255 and 256 are coupled to fluid passages 251 and 252. As a result, fluid is circulated between couplings 255 and 256 and the pump cavity (shown in dashed-line) which is coupled to passages 70 and 85 in a single pump cavity isolated fluid flow. Thus, fluid flowing into or out of couplings 255 and 256 which is pumped by the pump cavity within pump body 13 coupled to passages 70 and 85 is isolated from other fluids flowing within pump 250.

Similarly, manifold 250 includes a pair of fluid passages 261 and 262 coupled to passages 71 and 86 of transfer plate 12. Fluid passages 261 and 262 are encircled by annular seals 263 and 264 and are coupled to fluid couplers 265 and 266 respectively. Once again, the pump cavity (shown in dashed-line) within pump body 13 and transfer plate 12 is coupled to passages 71 and 86 which in turn are coupled to passages 261 and 262. Thus, an isolated flow of fluid into and out from couplers 265 and 266 is provided which is pumped solely by the pump cavity coupled to passages 71 and 86 of transfer plate 12.

It will be apparent to those skilled in the art by temporary reference for example to FIG. 4 that the alternate embodiment of the present invention shown in FIG. 13 may utilize a total of four independent pump couplings for each of the pump cavities formed in the embodiment of FIG. 4. Alternatively, by reference to the above-described alternate embodiments of the present invention in which pluralities of pump cavities beyond the four cavity embodiment shown in FIG. 4 are shown that additional fluids may be independently processed or pumped by pump 250 by providing independent coupling between their respective pluralities of pump cavities. Thus, a plurality of fluids may be isolated from each other while being simultaneously pumped in proportionate amounts through a single common pump. By way of further example, the independent coupling to each pump cavity within the present invention pump in the manner shown in FIG. 13 may be utilized to provide a predetermined ratio of fluid pumping. For example, if a four cavity pump such as that shown in FIG. 4 is utilized, three cavities may be coupled to a single fluid processing system while the fourth is coupled independently to provide a three to one ratio of fluid pumping which is extremely precise and which has the benefits of the above-described metering capability of the present invention pump. Other combinations may of course be utilized without departing from the embodiment shown in FIG. 13 and the present invention in its broader aspects.

While particular embodiments of the invention have been show and described, it will be obvious to those skilled in the art that changes and modifications may be made without departing from the invention in its broader aspects. Therefore, the aim in the appended claim is to cover all such changes and modification as fall within the true spirit and scope of the invention.

That which is claimed is:

1. A drive cavity pump for pumping a fluid, said pump comprising:

a pump housing having a plurality of pump cavities each defining a pump recess and first and second apertures in said recess;

a plurality of diaphragms sealingly supported upon said plurality of pump cavities each of said diaphragms being formed of a flexible resilient material which together with said pump recesses forms a sealed fluid cavity having said first and second apertures therein;

a first fluid coupling and means for coupling said first fluid coupling to said first apertures;

a second fluid coupling and means for coupling said second fluid coupling to said second apertures;

a plurality of diaphragm compression members; and means for moving said plurality of diaphragm compression members upon and across said diaphragms, said diaphragms being compressed into said recesses to block said first apertures and captivate a quantity of fluid and to expel said quantity outwardly through said second apertures.

2. The pump set forth in claim 1 wherein said pump cavities said recesses and said diaphragms define generally arcuate shapes.

3. The pump set forth in claim 2 wherein said plurality of diaphragm compression members include a plurality of rollers and wherein said means for moving said plurality of compression members includes a compression plate rotatably supported by said pump housing, said compression plate supporting said rollers.

4. The pump set forth in claim 3 wherein said plurality of diaphragms are commonly supported upon a cavity pad.

5. The pump set forth in claim 4 wherein said cavity pad and said plurality of diaphragms are formed as an integral one-piece resilient member.

6. The pump set forth in claim 5 wherein said pump cavities each include a surrounding groove and wherein said cavity pad includes a plurality of resilient seals each received within one of said grooves.

7. The pump set forth in claim 6 wherein said pump cavities and said diaphragms are concentrically arranged to generally define circular arrangements.

8. The pump set forth in claim 7 further including a generally planar pad support plate formed of a rigid material and defining a plurality of arcuate slots each sized and shaped to receive one of said diaphragms, said pad support plate being positioned upon said cavity pad.

9. The pump set forth in claim 7 wherein said pluralities of diaphragms and pump cavities are arranged in pluralities of concentric circles and wherein said rollers include correspondingly arranged pluralities of rollers traversing said circularly arranged diaphragms as said compression plate is rotated.

10. The pump set forth in claim 9 wherein said plurality of rollers include a plurality of elongated radially arranged rollers each extending upon a plurality of said concentric circles.

11. The pump set forth in claim 9 wherein said plurality of rollers are generally frusto-conical.

12. The pump set forth in claim 2 wherein said means for moving said diaphragm compression members includes a compression plate rotatably supported by said pump housing and wherein said diaphragm compression members include a plurality of undulations formed on said compression plate.

13. A rotary cavity pump for pumping a fluid, said pump comprising:

a transfer plate having a plurality of arcuate pump cavities each defining an arcuate recess, a first aperture and first passage at one end of each said recess and a second aperture and second passage at the remaining end of each said recess;

a manifold coupled to said transfer plate having a first fluid port coupled to each of said first passages and a second fluid port coupled to each of said second passages;

a plurality of resilient diaphragms each sealingly supported upon one of said pump cavities; and a compression plate rotatably supported with respect to said diaphragms and having a plurality of compression members, said compression members compressing said diaphragms as said compression plate rotates to isolate fluid within said recesses and expel it through said second apertures and said second passages.

14. The pump set forth in claim 13 wherein said manifold includes a surface defining a first circular groove and a second circular groove and wherein said manifold is joined to said transfer plate at said surface and wherein each of said first passages in said transfer plate communicates with said first groove and said second passages communicate with said second groove, said first fluid coupling communicating with said first groove and said second fluid coupling communicating with said second groove.

15. The pump set forth in claim 14 further including seal means for isolating said first groove from said second groove.

16. A rotary cavity pump for use with a fluid, said pump comprising:

a pump housing;

a compression plate rotatably supported on said pump housing and having a plurality of compression members;

a plurality of deformable pump segments supported by said pump housing against said compression members, each of said deformable pump segments including, an elongated pump cavity having an elongated recess having apertures at each end thereof, and a resilient diaphragm covering said pump cavity, said resilient diaphragm deforming and reforming as a compression member is moved upon it to draw fluid into said recess through one of said apertures and expel fluid out from said recess through the remaining one of said apertures.

17. The pump set forth in claim 16 wherein compression members are rollers each rotatably supported upon said compression plate.

18. A rotary cavity pump for use with a fluid, said pump comprising:

a pump housing;

a compression plate rotatably supported on said pump housing and having a plurality of compression members;

a plurality of deformable pump segments supported by said pump housing against said compression members, each of said deformable pump segments including, an elongated pump cavity having an elongated recess having first and second apertures at first and second ends thereof, and a resilient diaphragm covering said pump cavity, said resilient diaphragm deforming and reforming as a compression member is moved upon it to draw fluid into said recess through said first aperture and expel fluid out from said recess through said second aperture; and a transfer plate secured to said compression plate defining a plurality of fluid coupling passage pairs, each pair being coupled to said first and second apertures in said pump cavities.

19. The pump set forth in claim 1 wherein said manifold, and said transfer plate each define a center aperture and wherein said pump receives a power drive shaft passing through said pump for coupling to additional pumps.

* * * * *